US006193365B1

(12) United States Patent
Ikezaki

(10) Patent No.: US 6,193,365 B1
(45) Date of Patent: Feb. 27, 2001

(54) HOT MELT TYPE INKJET HEAD AND SHEET SHAPED HEATING DEVICE USED FOR HOT MELT TYPE INKJET HEAD

(75) Inventor: Yoshiyuki Ikezaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/098,420

(22) Filed: Jun. 16, 1998

(30) Foreign Application Priority Data

Jun. 19, 1997 (JP) ..... 9-162973

(51) Int. Cl.[7] ..... B41J 2/175
(52) U.S. Cl. ..... 347/88; 219/543
(58) Field of Search ..... 347/88, 60, 99, 347/62, 19, 17, 204, 209, 56, 58, 57, 61, 68; 219/543, 216, 528, 549, 529

(56) References Cited

U.S. PATENT DOCUMENTS 5,017,941 * 5/1991 Drake ..... 347/18
5,424,767 * 6/1995 Alavizadeh et al. ..... 347/17
5,635,964 * 6/1997 Burr et al. ..... 347/17
5,939,206 * 8/1999 Kneezel et al. ..... 428/480

FOREIGN PATENT DOCUMENTS 42 23 707 * 1/1993 (DE) ..... 347/63
0 780 233 * 6/1997 (EP) .
0013031 * 1/1979 (JP) ..... 219/543

* cited by examiner

*Primary Examiner*—N. Le
*Assistant Examiner*—Shih-Wen Hsieh
(74) *Attorney, Agent, or Firm*—Oliff & Berridge, PLC

(57) ABSTRACT

A sheet shaped heating device attached on a contact surface of a mounting part of a hot melt type inkjet head for applying heat to the mounting part in order to heat hot melt ink in the hot melt type inkjet head, the sheet shaped heating device having: an insulating sheet having an attaching surface to be attached on the contact surface of the mounting part and a wiring surface located opposite to the attaching surface; and a heating element disposed on the wiring surface of the insulating sheet for generating heat, wherein at least one air passage passing through the insulating sheet is formed.

29 Claims, 7 Drawing Sheets

HOT MELT TYPE INKJET HEAD AND SHEET SHAPED HEATING DEVICE USED FOR HOT MELT TYPE INKJET HEAD

BACKGROUND OF THE INVENTION

1. Field of the Invention

The present invention relates generally to a head of a hot melt type inkjet printer, and more particularly to a sheet shaped heating device used for a head of a hot melt type inkiet printer.

2. Description of the Related Art

A hot melt type inkiet head has a plurality of nozzle heads corresponding to a plurality of colors of inks actually used for printing, respectively. Each of the nozzle heads has a large number of nozzle holes. In such a hot melt type inkiet head, when printing, solid hot melt inks are melted by heat, and then, the hot melt inks in the liquid state are ejected through the nozzle holes. Therefore, it is necessary to heat up the inks quickly at the start of printing, and keep temperature of the inks at a predetermined high temperature during printing. Here, a performance of an ink ejection is sensitively changed with temperature of inks. If temperature of each nozzle head is not uniform, ejection speed of inks irregularly varies. As a result, printing quality is reduced. Therefore, in order to enhance the printing quality, it is necessary to apply heat to each nozzle head suitably, and that an optimum temperature distribution is set for each nozzle head. In order to apply heat to each nozzle head, the hot melt type inkjet head has a sheet shaped heater.

A sheet shaped heater is typically used as a heater for the hot melt type inkiet head. The sheet shaped heater has an insulating sheet made of polyimide or the like. On the insulating sheet, a meandering wiring pattern is formed. Width and length of the wire of the wiring pattern are designed so as to set a certain wattage density in each part of the wire. The sheet shaped heater is attached near the nozzle heads, and applies heat to the nozzle heads in order to set an optimum temperature distribution for each nozzle head. More concretely, the sheet shaped heater is bonded to a mounting part of the inkiet head located near the nozzle heads by using an adhesive etc., in a condition that a surface of the sheet shaped heater abuts a surface of the mounting part. Therefore, heat generated by the wiring pattern of the sheet shaped heater is conduct to the nozzle head through the mounting part.

However, the surface of the mounting part is flat and relatively hard, whereas the surface of the sheet shaped heater is easy to curve, since the insulating sheet made of polyimide or the like is soft and flexible. In case that the surface of the sheet shaped heater has curved and a concave portion has been formed on it, if the surface of the sheet shaped heater is bonded to the surface of the mounting part, an enclosed space is formed between them, and air is confined in the enclosed space.

Furthermore, if the enclose space is formed in the vicinity of the middle of the surface of the sheet shaped heater, it is difficult to remove the air and the enclosed space.

Moreover, if the enclosed space has been formed, the surface of the sheet shaped heater is partially separate from the surface of the mounting part. Hence, heat generated by the wiring pattern is not completely conducted to the nozzle head through the mounting part. Accordingly, thermal efficiency is reduced, a temperature distribution is dispersed, and printing quality is reduced.

SUMMARY OF THE INVENTION

It is therefore an object of the present invention to provide a hot melt type inkjet head and a heating device to be used for a hot melt type inkjet head, wherein a surface of the heating device can be completely bonded to a surface of a mounting part of the hot melt type inkjet head without a space between them, and heat can be completely conducted to the mounting part.

According to the present invention, the aforementioned object can be achieved by a sheet shaped heating device attached on a contact surface of a mounting part of a hot melt type inkjet head for applying heat to the mounting part in order to heat hot melt ink in the hot melt type inkjet head, the sheet shaped heating device having: an insulating sheet having an attaching surface to be attached on the contact surface of the mounting part and a wiring surface located opposite to the attaching surface; and a heating element disposed on the wiring surface of the insulating sheet for generating heat, wherein at least one air passage passing through the insulating sheet is formed.

Namely, the sheet shaped heating device is attached on the contact surface of the mounting part of the hot melt type inkjet head. Therefore, when the heating element generates heat, the heat is conducted to the mounting part through the insulating sheet. Therefore, the hot melt ink in the hot melt type inkiet head is heated.

Here, the air passage is formed through the insulating sheet. Therefore, when the sheet shaped heating device is attached on the contact surface of the mounting part, it is possible to let air escape from between the attaching surface of the insulating sheet and the contact surface of the mounting part thought the air passage. Thus, it is possible to remove air and a space from between them. Accordingly, it is possible to bond the attaching surface of the heating device to the contact surface of amounting part completely. Therefore, heat generated by the heating element can be completely conducted to the mounting part.

Otherwise, it is preferable that the air passage is a hole. Furthermore, the air passage may be a hole shaped like a slit extending along the attaching surface of the insulating sheet. Moreover, the air passage is located in a vicinity of a middle of the attaching surface of the insulating sheet. Therefore, it is possible to let air escape advantageously.

Moreover, a sheet shaped insulating cover may be disposed on the wiring surface of the insulating sheet for covering the heating element. In this case, the air passage is formed through the insulating sheet and the sheet shaped insulating cover. Therefore, not only the attaching surface of the insulating sheet but also a surface of the insulating cover can be alternatively attached on the contact surface of the mounting part. Accordingly, it is possible to improve flexibility of design.

According to the present invention, the above mentioned object can be also achieved by an hot melt type inkjet head having: an ink tank for storing hot melt ink; a nozzle for ejecting the hot melt ink; an ink supplying member having an inside wall defining an ink channel for supplying the hot melt ink from the ink tank to the nozzle therethrough, and having an outside contact surface located opposite to the inside wall; a sheet shaped heating device attached on the outside contact surface of the ink supplying member for applying heat to the hot melt ink passing through the ink channel, the sheet shaped heating device having: an insulating sheet having an attaching surface to be attached on the outside contact surface of the ink supplying member and a wiring surface located opposite to the attaching surface; and a heating element disposed on the wiring surface of the insulating sheet for generating heat, wherein at least one air passage passing through the insulating sheet is formed.

Therefore, when the sheet shaped heating device is attached on the outside contact surface of the ink supplying member, it is possible to let air escape from between the attaching surface of the insulating sheet and the outside contact surface of the ink supplying member thought the air passage. Thus, it is possible to remove air and a space from between them. Accordingly, it is possible to bond the attaching surface of the heating device to the outside contact surface of the ink supplying member completely.

The nature, utility, and further feature of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring to the accompanying drawings, embodiment of the present invention is explained.

First, a configuration of a head of a hot melt type inkjet printer is explained with reference to FIGS. 1 and 2.

Figure 1:
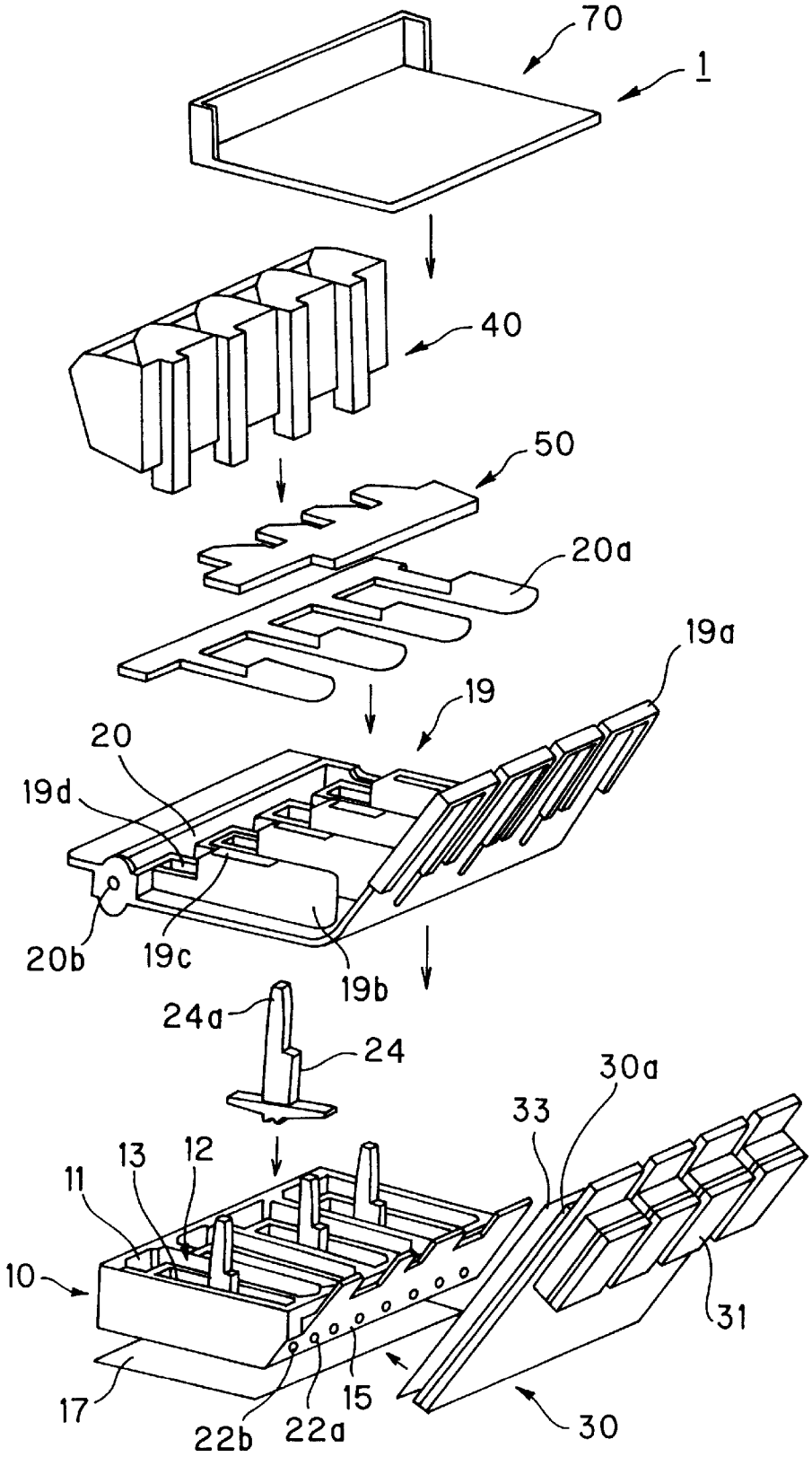
FIG. 1 is a perspective view showing a configuration of a hot melt type inkjet head of an embodiment of the present invention.
Figure 2:
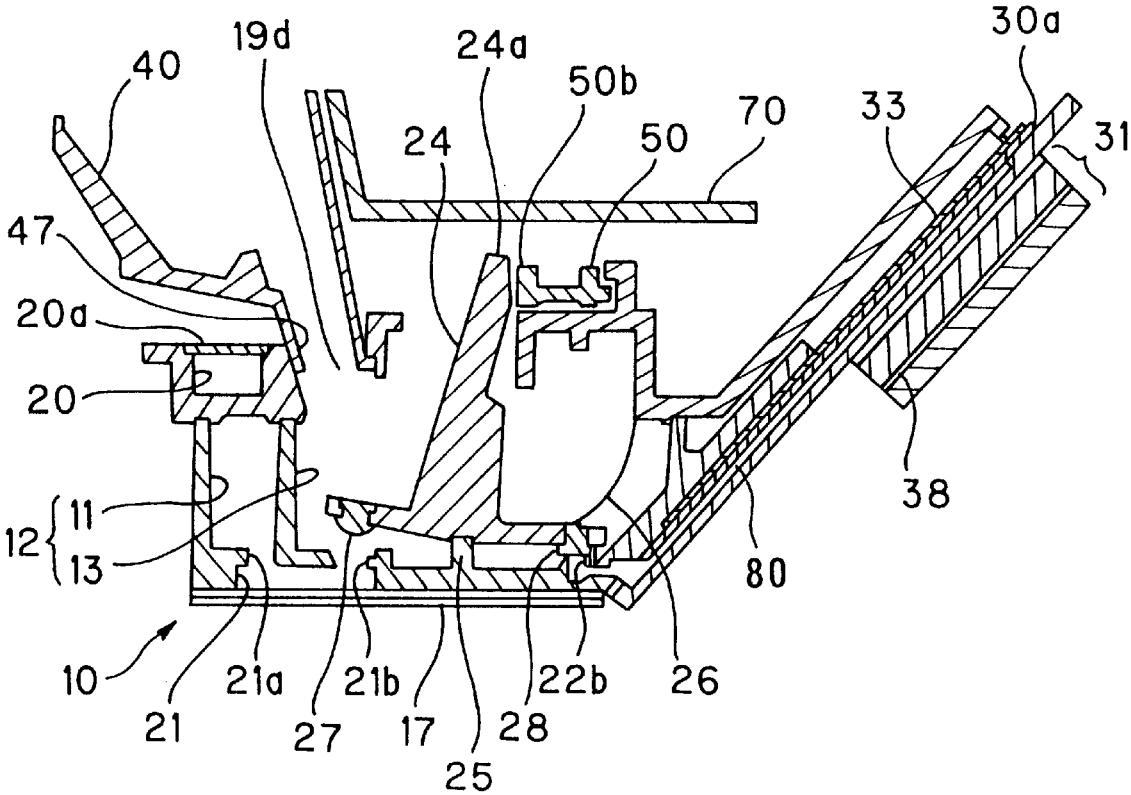
FIG. 2 is a sectional view of the hot melt type inkjet head of the embodiment.

As shown in FIG. 1, the head 1 of the hot melt type inkjet printer has: an ink tank 10; a front panel 30; an ink supplying tank 40; a cam member 50; and a control substrate stage 70.

The ink tank 10 has: a front face portion 15 that slops with respect to a bottom face of the ink tank 10 in order to allow a front panel 30 to be attached thereon; four chambers 12 for storing four colors of inks, such as yellow, magenta, cyan and black, therein, respectively; an ink tank cover 19; an ink heater 17 attached on the bottom face of the ink tank 10. Furthermore, each chamber 12 is divided into two parts, i.e., a main chamber 11 and sub chamber 13. As shown in FIG. 2, a plurality of passages 21 are formed under the main chambers 11 and the sub chambers 13.

Each of the main chambers 11 is shaped like an letter "L" as seeing from the over side, and has a main chamber inlet 21*a* connecting between the main chamber 11 and the passage 21, and a main chamber outlet 22*a* connecting between the passage 21 and the front panel 30. Similarly, each of the sub chambers 13 has a sub chamber inlet 21*b* and a sub chamber outlet 22*b*.

Furthermore, a plurality of valve levers 24 are installed in the ink tank 10. Each of the valve levers 24 is made of aluminium alloy and formed by die-casting. As shown in FIG. 2, the valve levers 24 are mounted on lever pedestals 25, respectively, and each of the lever pedestals 25 is positioned between the sub chamber inlet 21*b* and the sub chamber outlet 22*b*. Each of the valve levers 24 can be rocked based upon the lever pedestal 25 serving as a fulcrum. Moreover, each of the valve levers 24 has valve portions 27 and 28. The valve portion 28 is always pressed downward by a valve spring 26, so that the outlet 22*b* is usually closed by the valve portion 28.

The ink tank cover 19 has: a front panel cover portion 19*a* formed in the shape corresponding to the front panel 30 for covering the front panel 30; a sub chamber cover portion 19*b* for covering the sub chambers 13; a plurality of slotted holes 19*c* through which the upper end portions 24*a* of the valve levers 24 are inserted, respectively; a plurality of ink inlets 19*d* for supplying hot melt inks from the ink supplying tanks 40 to the sub chambers 13, respectively: an air chamber 20 for supplying a compressed air from a compressor (not shown in figures) to the main chambers 11; a through hole 20*b* for supplying the compressed air from the compressor into the air chamber 20; and an air chamber cover 20*a* for sealing up the air chamber 20.

The front panel 30 has a front face and a rear face. Four nozzle heads 31 are attached on the front face. A cover panel 30*a* is attached on the rear face. Furthermore, a front panel heater 33 is attached on the cover panel 30*a*. Moreover, the front panel 30 serves as an ink supplying member. As shown in FIG. 2, a plurality of ink channels 80 are defined by an inside wall of the cover panel 30*a* and an inside wall of the front panel 30. The inks stored in the chambers 12 are supplied to the nozzle heads 31 through the ink channels 80, respectively. Moreover, each of the nozzle heads 31 has 128 small nozzle holes and piezoelectric elements 38, and ejects ink onto a recording medium by applying pressure to the ink. In addition, the pressure is produced by changing volume of the piezoelectric elements 38.

The cam member 50 is mounted on the ink tank cover 19, and can slide in the horizontal direction. As shown in FIG. 2, the cam member 50 is usually positioned by a spring (not shown in figures) such that the cam face 50*b* does not touch the upper end portion 24*a* of the valve lever 24.

The ink supplying chamber 40 is divide into four parts, which correspond to four colors of inks, such as black, cyan, magenta and yellow, respectively. Each part is shaped like a box and has an opening at its upper side in order to supply a solid ink thereinto by a solid ink supplying device (not shown in figures). The supplied solid inks are heated up in ink supplying chamber 40, and therefore, the solid inks are melted. Thereafter, the molten inks are supplied to the sub chambers 13 of the ink tank 10 though passages 47.

The control substrate stage 70 is mounted on the upper part of the head 1. The control substrate stage 70 is a mount to mount a control substrate (not shown in figures). In addition, the control substrate is a member having a substrate on which a control circuit is formed.

Next, a configuration of the front panel heater 33 is explained with reference to FIGS. 3A to 6.

The front panel heater 33 has: an insulating sheet 33*b* having 25 $\mu$m thickness, made of polyimide, and serving as a base layer; a meandering wiring pattern 34 formed on a wiring surface of the insulating sheet 33*b* by etching, having 30 $\mu$m thickness, and serving as a heating element; and an insulating cover having 25 $\mu$m thickness, made of polyimide, and serving as a covering. The insulating cover is bonded onto the wiring surface of the insulating sheet 33*b*, on which the wiring pattern 34 is formed. Namely, both the wiring surface of the insulating sheet 33*b* and the wiring pattern 34 are covered with the insulating cover.

Figure 3A:
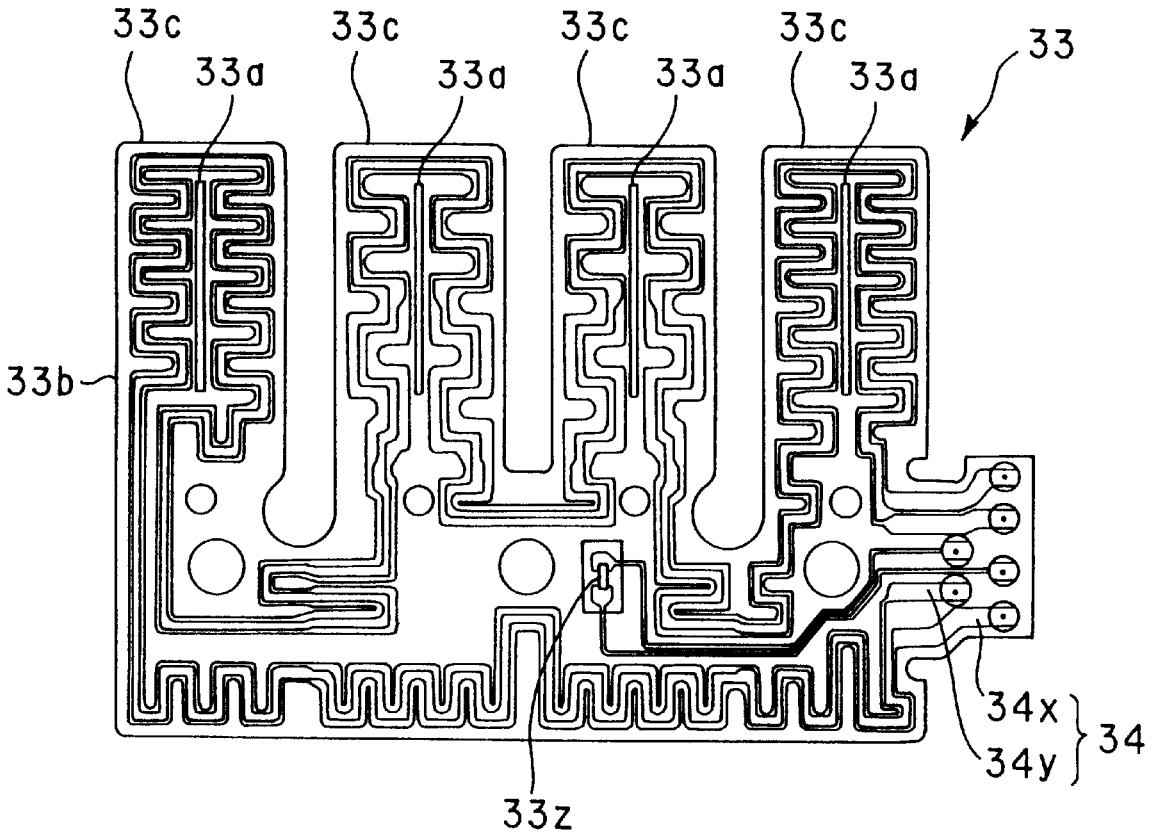
FIG. 3A is a plan view of a front panel heater of the embodiment.

As shown in FIG. 3A, width and length of each wire of the wiring pattern 34 is changed for each heating area on the insulating sheet 33*b* in order to set a different wattage density for each heating area with the object of generating optimum heat for each heating area. The heating areas are positioned opposite to parts where the nozzle heads 31 are formed, and opposite to passage parts located below the nozzle heads 31, respectively.

Furthermore, as shown in FIG. 3A, the wiring pattern 34 is formed by two electric resistance wires 34*x* and 34*y* made of stainless. The first electric resistance wire 34*x* is arranged in the outside, and the second electric resistance wire 34*y* is arranged in the inside. The first electric resistance wire 34*x* is a heating means to generate heat during printing. Namely, it generates heat during printing in order to keep temperature of each heating area at a predetermined temperature. On the other hand, the second electric resistance wire 34*y* is a fast heating means, and it is used in order to heat up quickly at the start of printing.

Moreover, a thermistor 33*z* serving as a temperature sensor is mounted at the vicinity of the middle of the front panel heater 33. The heat of each of the electric resistance wires 34*x* and 34*y* is controlled based upon the temperature detected by the thermistor 33*z*.

The front panel heater 33 is attached on the front panel 30 together with a cover panel 30*a* such that its heating areas are positioned opposite to parts where the nozzle heads 31 are placed, and opposite to passage parts located below the nozzle heads 31, respectively. The cover panel 30*a* is placed between the front panel heater 33 and the front panel 30. Furthermore, the front panel heater 33 and the cover panel 30*a* are bonded to each other by using an adhesive and particularly a silicon adhesive.

Figure 3B:
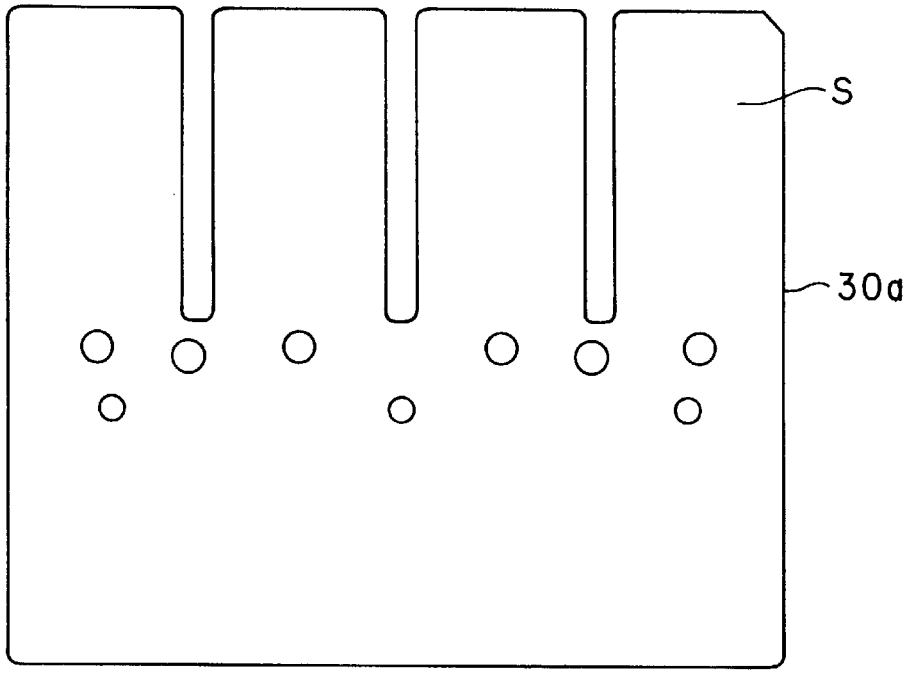
FIG. 3B is a plan view of a cover panel of the embodiment.

As shown in FIG. 3B, the cover panel 30*a* has a contact surface S to allow the front panel heater 33 to be mounted thereon. On the other hand, the front panel heater 33 has an attaching surface to be attached onto the contact surface S. For example, the surface that is opposite to the wiring surface of the insulating sheet 33*b*, and on which the wiring pattern 34 is not formed, serves as the attaching surface.

Figure 3C:
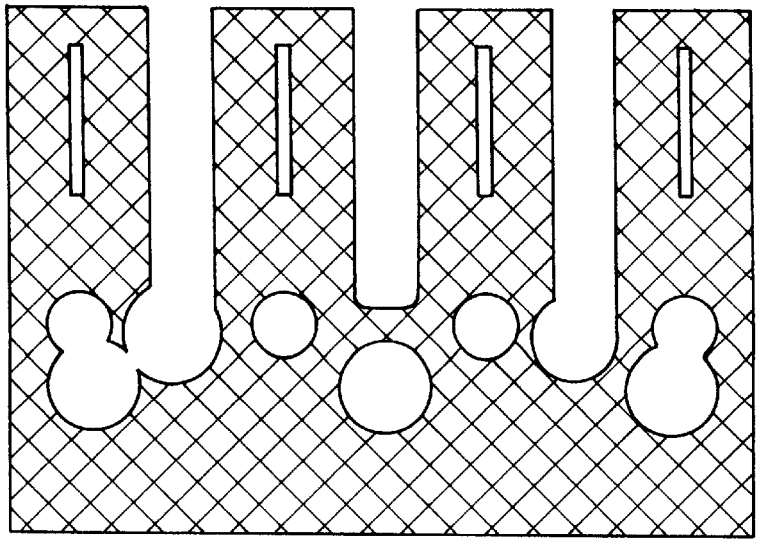
FIG. 3C is a diagram showing a bonding area of the cover panel of the embodiment.

The front panel heater 33 is attached on the cover panel 30*a* as follows: first, as shown in FIG. 3C, the adhesive is applied onto the contact surface S of the cover panel 30*a*; and next, the front panel heater 33 is placed onto the contact surface S such that the attaching surface of the front panel heater 33 abuts the contact surface S; and next, these panels are heated up, thereby hardening the adhesive. Thus, as shown in FIG. 4, the front panel heater 33 is fastened on the contact surface S, and therefore, the front panel heater 33 and the cover panel 30*a* are integrated with each other.

Figure 4:
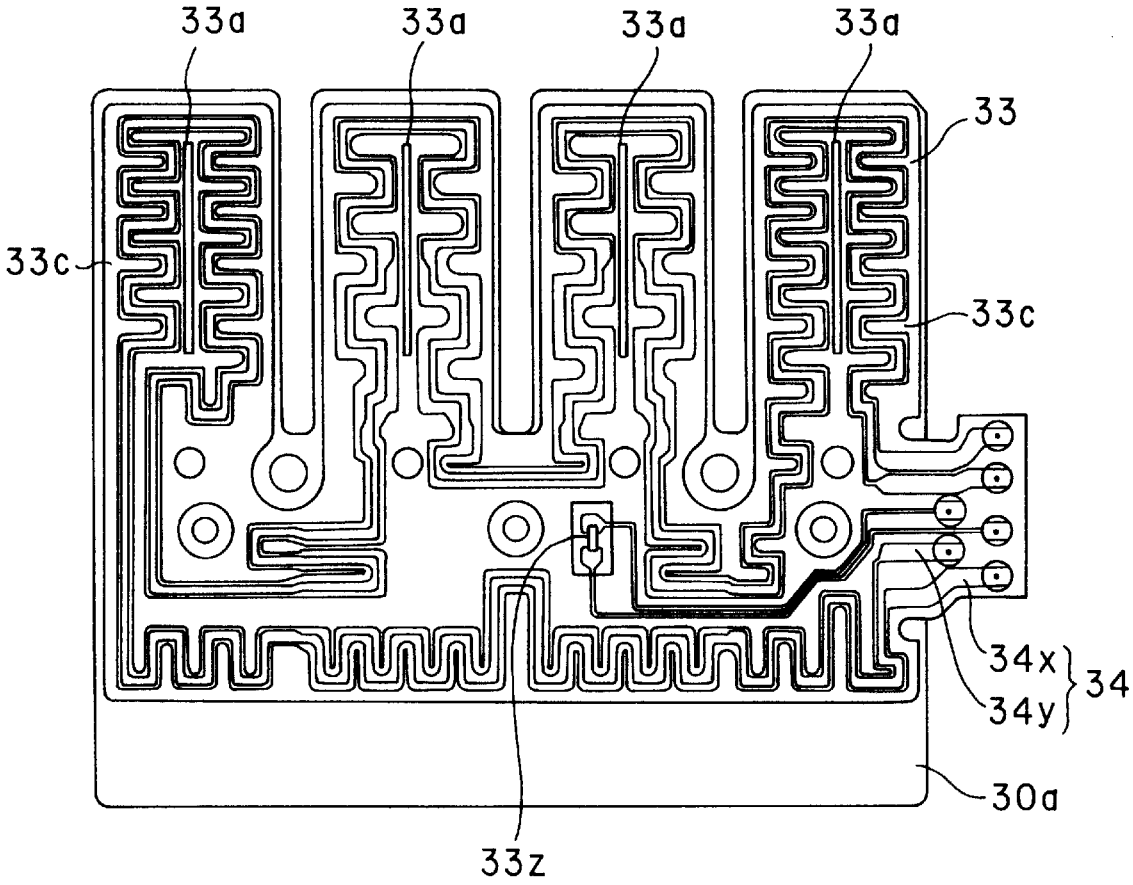
FIG 4 is a plan view showing the front panel heater attached on the cover panel of the embodiment.

Furthermore, as shown in FIG. 4, the front panel heater 33 has four nozzle head heating portions 33*c* which correspond to four nozzle heads 31. Each nozzle head heating portion 33*c* is positioned opposite to the part where the corresponding nozzle head 31 is placed.

Figure 5:
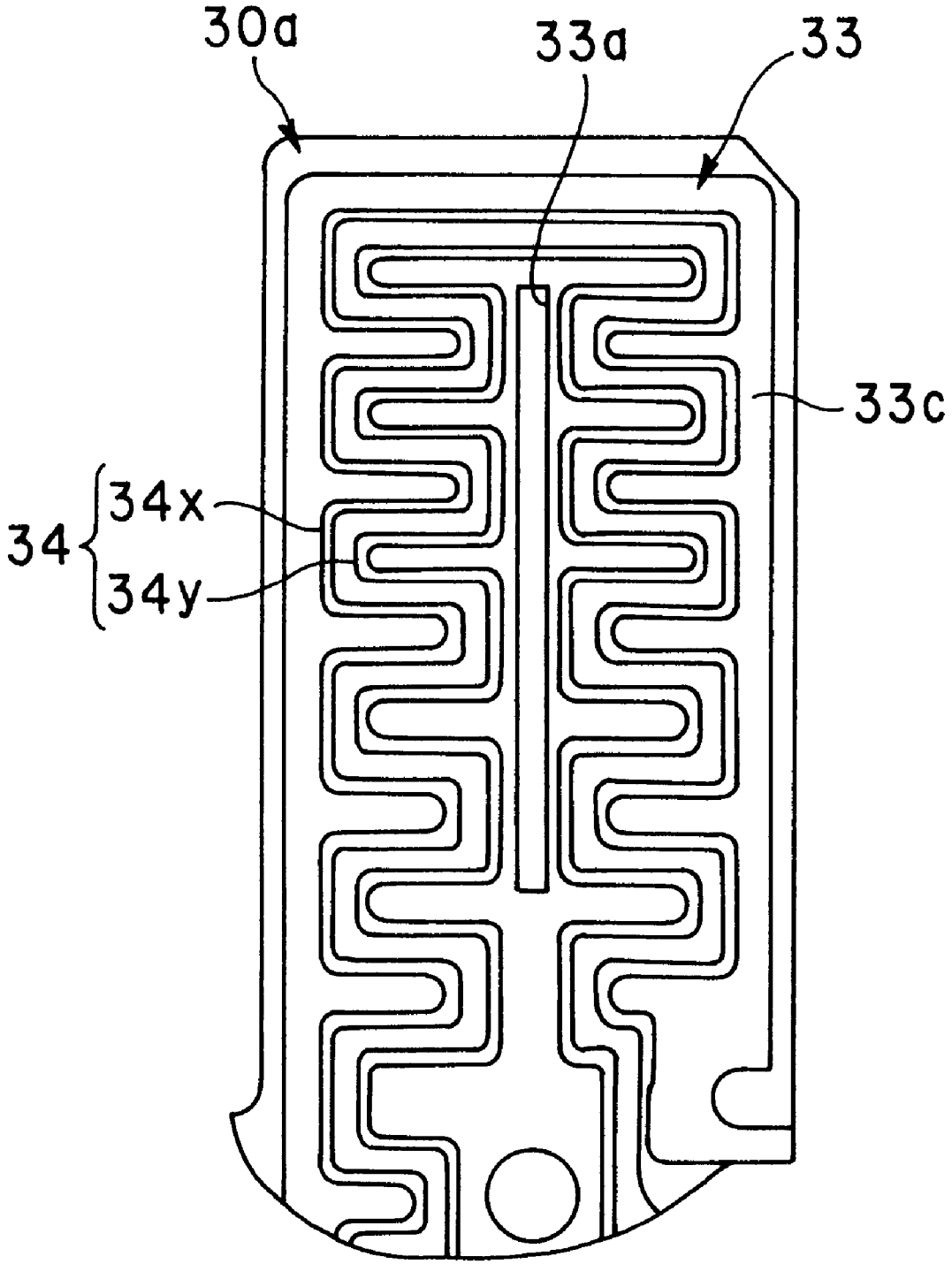
FIG 5 is an enlarged view of the front panel heater in which an air passing hole is formed according to the embodiment of the present invention.

In the embodiment, an air passing hole 33*a* serving as an air passage is formed in the each nozzle head heating portion 33*c*. FIG. 5 is an enlarged view showing one of the nozzle head heating portions 33*c*. As shown in FIG. 5, the air passing hole 33*a* is formed in the vicinity of the middle of the nozzle head heating portion 33*c*, and shaped like slit extending in the longitudinal direction of the nozzle head heating portion 33*c*. Furthermore, the air passing hole 33*a* is located in the part where the wiring pattern 34 is not arranged. Namely, the electric resistance wires 34*x* and 34*y* are arranged around the air passing hole 33*a*. The air passing hole 33*a* is formed through the front panel heater 33 so as to let air escape from between the front panel heater 33 and the cover panel 30*a*. That is, the air passing hole 33*a* is passing through both the insulating sheet 33*b* and the insulating cover.

Here, the contact surface S of the cover panel 30*a* is flat. Furthermore, as the cover panel 30*a* is made of, for example, aluminium, the contact surface S is relatively hard. On the other hand, the attaching surface of the front panel heater 30, i.e., the surface of the insulating sheet 33*b* is easy to curve or deform, because the insulating sheet is made of polyimide. For this reason, in case that the attaching surface of the front panel heater 33 has curved or deformed and a concave has been formed on it, when the attaching surface of the front panel heater 33 is placed onto the contact surface S of the cover panel 30*a* , there is a possibility that spaces may be formed temporarily between them. However, since the air passing hole 33*a* is formed in each nozzle head heating portion 33*c* of the front panel heater 33, it is possible to let air escape from the spaces, remove the spaces, and bond the attaching surface of the front panel heater 33 to the contact surface S completely. Therefore, heat generated by the front panel heater 33 can be completely conducted to the nozzle heads 31 through the cover panel 30*a*.

Figure 6:
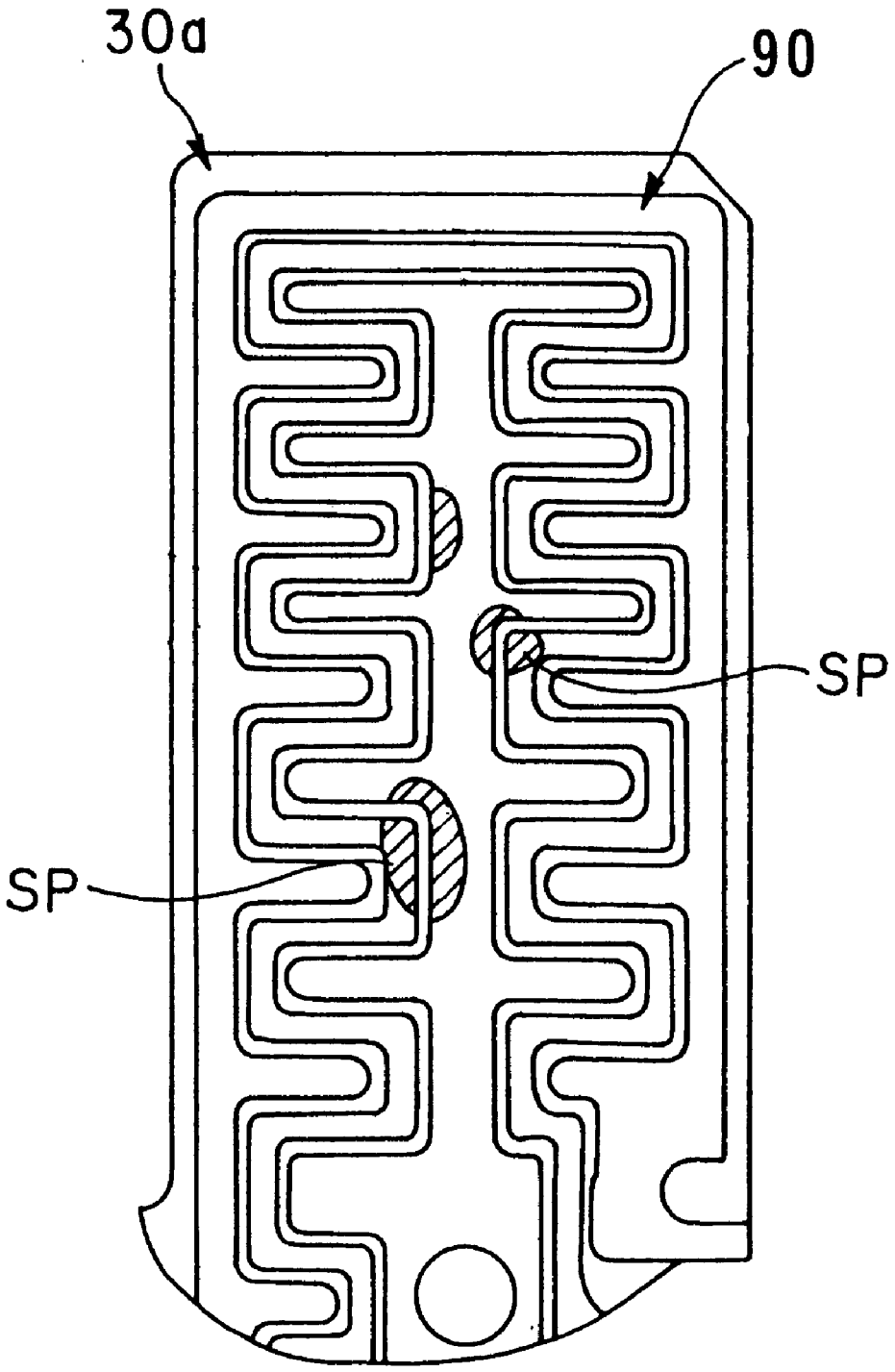
FIG 6 is a diagram showing a comparative example of a front panel heater in which the air passing hole is not formed.

Here, FIG. 6 shows an comparative example of a front panel heater for the purpose of confirming the above mentioned advantage of the present invention. As shown in FIG. 6, the front panel heater 90 does not have any air passage such as an air passing hole. As a result, when the attaching surface of the front panel heater 90 is bonded onto the contact surface of the cover panel 30*a*, enclosed spaces SP may be formed between the attaching surface and the contact surface, and air may be confined in the enclosed spaces SP. Since there is no air passage, the air remains in the enclosed spaces SP.

However, according to the front panel heater 33 of the embodiment of the present invention, it is possible to solve this problem by the air passing hole 33*a*, as shown in FIG. 5.

Hence, according to the inkjet head 1 of the embodiment of the present invention, it is possible to improve thermal efficiency, prevent a temperature distribution from dispersing, and make an ink ejection performance of each of the nozzle heads 31 stable. Consequently, according to the head 1 of the embodiment, it is possible to enhance the printing quality.

In addition, the position and the shape of the air passing hole 33*a* is not limited. For example, the air passing hole may be shaped into a circle or the like. Namely, the position and the shape of the air passing hole may be designed depending on a shape of the front panel heater and/or an arrangement of the wiring pattern. Furthermore, the number of the air passing hole may be increased in order to make it easier to let air escape. Moreover, in the embodiment, the front panel heater 33 is made of polyimide. However, the present invention is not limited to this. For example, in case that the front panel heater is used in lower temperature, the front panel heater may be made of polyester. Moreover, a setting position of the front panel heater is not limited. Namely, in the embodiment, the front panel heater 33 is attached on the contact surface S of the cover panel 30*a*. However, the front panel heater may be attached on another part near the nozzle heads 31. Moreover, in the embodiment, when the front panel heater 33 is bonded onto the contact surface S, the surface of the insulating sheet 33*b* abuts the contact surface S. However, the surface of the insulating cover may abut the contact surface S.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A sheet shaped heating device attached on a contact surface of a mounting part of a printhead for applying heat to the mounting part in order to heat ink in the printhead, the sheet shaped heating device comprising:

an insulating sheet having an attaching surface to be attached on the contact surface of the mounting part and a wiring surface located opposite to the attaching surface; and a heating element disposed on the wiring surface of the insulating sheet for generating heat, wherein at least one air passage passing through the insulating sheet is formed, the insulating sheet comprises an elastic body, and is attached at a location where no ink is directly in contact with the heating element.

2. A sheet shaped heating device according to claim 1, wherein the air passage is a hole.

3. A sheet shaped heating device according to claim 1, wherein the air passage is a hole shaped like a slit extending along the attaching surface of the insulating sheet.

4. A sheet shaped heating device according to claim 1, wherein the air passage is located in a vicinity of a middle of the attaching surface of the insulating sheet.

5. A sheet shaped heating device according to claim 1, wherein the sheet shaped heating device further comprises a sheet shaped insulating cover disposed on the wiring surface of the insulating sheet for covering the heating element, and the air passage is formed through the insulating sheet and the sheet shaped insulating cover.

6. A sheet shaped heating device according to claim 1, wherein the insulating sheet includes polyimide.

7. A sheet shaped heating device according to claim 1, wherein the heating element is formed by wiring pattern.

8. A sheet shaped heating device according to claim 1, wherein the heating element is arranged around the air passage.

9. A sheet shaped heating device according to claim 1, wherein the print head is a hot melt inkjet head adapted for use of hot melt ink.

10. A sheet shaped heating device according to claim 1, wherein the attaching surface of the insulating sheet has a first edge and a second edge opposite to each other, and the air passage is located such that a distance between the air passage and the first edge is approximately equal to a distance between the air passage and the second edge.

11. A sheet shaped heating device according to claim 1, wherein the print head has a plurality of nozzles, the attaching surface of the insulating sheet has a plurality of heating areas corresponding to the nozzles respectively, and the air passage is formed in each of the heating areas.

12. A printhead comprising:

(A) an ink tank for storing ink;

(B) a nozzle for ejecting the ink;

(C) an ink supplying member having an inside wall defining an ink channel for supplying the ink from the ink tank to the nozzle therethrough, and having an outside contact surface located opposite to the inside wall;

(D) a sheet shaped heating device attached on the outside contact surface of the ink supply member for applying heat to the ink passing through the ink channel, the sheet shaped heating device comprising:

an insulating sheet having an attaching surface to be attached on the outside contact surface of the ink supplying member and a wiring surface located opposite to the attaching surface; and a heating element disposed on the wiring surface of the insulating sheet for generating heat, wherein at least one air passage passing through the insulating sheet is formed, the insulating sheet comprises an elastic body, and is attached at a location where no ink is directly in contact with the heating element.

13. A print head according to claim 12, wherein the air passage is a hole.

14. A print head according to claim 12, wherein the air passage is a hole shaped like a slit extending along the attaching surface of the insulating sheet.

15. A print head according to claim 12, wherein the air passage is located in a vicinity of a middle of the attaching surface of the insulating sheet.

16. A print head according to claim 12, wherein the sheet shaped heating device further comprises a sheet shaped insulating cover disposed on the wiring surface of the insulating sheet for covering the heating element, and the air passage is formed through the insulating sheet and the sheet shaped insulating cover.

17. A print head according to claim 12, wherein the insulating sheet includes polyimide.

18. A print head according to claim 12, wherein the heating element is formed by wiring pattern.

19. A print head according to claim 12, wherein the heating element is arranged around the air passage.

20. A print head according to claim 12 is a hot melt inkjet head adapted for use of hot melt ink.

21. A print head according to claim 12, wherein the attaching surface of the insulating sheet has a first edge and a second edge opposite to each other, and the air passage is located such that a distance between the air passage and the first edge is approximately equal to a distance between the air passage and the second edge.

22. A print head, comprising:

(A) an ink tank for storing ink;

(B) a plurality of nozzles for ejecting the ink;

(C) an ink supplying member having an inside wall defining a plurality of ink channels for supplying the ink from the ink tank to the nozzles therethrough, and having an outside contact surface located opposite to the inside wall;

(D) a sheet shaped heating device attached on the outside contact surface of the ink supplying member for applying heat to the ink passing through the ink channels, the sheet shaped heating device comprising:

an insulating sheet having an attaching surface to be attached on the outside contact surface of the ink supplying member and a wiring surface located opposite to the attaching surface; and a heating element disposed on the wiring surface of the insulating sheet for generating heat, wherein the attaching surface of the insulating sheet has a plurality of heating areas corresponding to the ink channels respectively, a plurality of air passages passing through the insulating sheet are formed therein, and the air passages are located in the heating areas, respectively, wherein the insulating sheet comprises an elastic body, and is attached at a location where no ink is directly in contact with the heating element.

23. A print head according to claim 22, wherein each of the air passages is a hole.

24. A print head according to claim 22, wherein each of the air passages is a hole shaped like a slit extending along the attaching surface of the insulating sheet.

25. A print head according to claim 22, wherein each of the air passages is located in a vicinity of a middle of the heating area.

26. A print head according to claim 22, wherein the sheet shaped heating device further comprises a sheet shaped insulating cover disposed on the wiring surface of the insulating sheet for covering the heating element, and each of the air passages is formed through the insulating sheet and the sheet shaped insulating cover.

27. A print head according to claim 22, wherein the insulating sheet includes polyimide.

28. A print head according to claim 22, wherein the heating element is formed by wiring pattern.

29. A print head according to claim 22, wherein the heating element is arranged around each of the air passages.

* * * * *